US010952535B2

(12) United States Patent
Bucholz et al.

(10) Patent No.: US 10,952,535 B2
(45) Date of Patent: Mar. 23, 2021

(54) FURNITURE MEMBER HAVING LUMBAR ADJUSTMENT MECHANISM

(71) Applicant: La-Z-Boy Incorporated, Monroe, MI (US)

(72) Inventors: Brandon Bucholz, Chattanooga, TN (US); Alexander M. Hegedus, Chattanooga, TN (US)

(73) Assignee: LA-Z-BOY INCORPORATED, Monroe, MI (US)

( * ) Notice: Subject to any disclaimer, the term of this patent is extended or adjusted under 35 U.S.C. 154(b) by 0 days.

(21) Appl. No.: 16/672,878

(22) Filed: Nov. 4, 2019

(65) Prior Publication Data

US 2020/0138198 A1 May 7, 2020

Related U.S. Application Data

(60) Provisional application No. 62/755,849, filed on Nov. 5, 2018.

(51) Int. Cl.
*A47C 7/46* (2006.01)

(52) U.S. Cl.
CPC ..... *A47C 7/462* (2013.01)

(58) Field of Classification Search
CPC ..... B60N 2/6671; B60N 2/6673; B60N 2/66; B60N 2/666; A47C 7/46; A47C 1/03255;
(Continued)

(56) References Cited

U.S. PATENT DOCUMENTS 3,588,170 A 6/1971 Knabusch et al.
3,890,000 A 6/1975 Easley
(Continued)

FOREIGN PATENT DOCUMENTS

CN 201438906 U 4/2010
DE 3600790 A1 7/1987
(Continued)

OTHER PUBLICATIONS

International Search Report for Application No. PCT/US2011/047371, dated Apr. 9, 2012.
(Continued)

*Primary Examiner* — Shin H Kim
(74) *Attorney, Agent, or Firm* — Harness, Dickey & Pierce, P.L.C.

(57) ABSTRACT

A seating or furniture assembly may include a seat bottom, a seatback, and a lumbar adjustment assembly. The seatback is disposed adjacent the seat bottom and includes a seatback frame. The lumbar adjustment assembly may be mounted to the seatback frame and may include a rail, a threaded rod disposed within the rail, a first slider block slidably engaging the rail, a second slider block slidably engaging the rail, a lumbar pad, and a plurality of links connecting the lumbar pad to the first and second slider blocks. The threaded rod may include a first threaded section having threads with a first handedness and a second threaded section having threads with a second handedness that is opposite the first handedness. The first slider block may threadably engage the first threaded section. The second slider block may threadably engage the second threaded section.

21 Claims, 9 Drawing Sheets

(58) Field of Classification Search
CPC ..... A47C 7/462; A47C 1/023; A47C 1/03238; A47C 1/03274
See application file for complete search history.

(56) References Cited

U.S. PATENT DOCUMENTS 4,072,287 A 2/1978 Swenson et al.
4,148,522 A 4/1979 Sakurada et al.
4,182,533 A 1/1980 Arndt et al.
4,295,681 A 10/1981 Gregory
4,296,965 A 10/1981 Sakurada et al.
4,354,709 A 10/1982 Schuster
4,469,374 A * 9/1984 Kashihara ..... B60N 2/66 297/284.4
4,678,230 A 7/1987 Winkle
4,725,095 A 2/1988 Benson et al.
4,968,093 A 11/1990 Dal Monte
4,981,325 A 1/1991 Zacharkow
5,007,677 A 4/1991 Ozawa et al.
5,087,098 A 2/1992 Ishizuka
5,088,790 A 2/1992 Wainwright et al.
5,217,278 A 6/1993 Harrison et al.
5,240,308 A 8/1993 Goldstein et al.
5,299,851 A 4/1994 Lin
5,462,335 A 10/1995 Seyler
5,474,358 A 12/1995 Maeyaert
5,482,350 A 1/1996 Komorowski et al.
5,507,559 A * 4/1996 Lance ..... B60N 2/6673 297/284.5
5,553,919 A 9/1996 Dennis
5,651,580 A 7/1997 LaPointe et al.
5,730,494 A 3/1998 LaPointe et al.
5,871,258 A 2/1999 Battey et al.
5,927,144 A 7/1999 Koch
5,979,984 A 11/1999 DeKraker et al.
5,984,407 A 11/1999 Ligon, Sr. et al.
6,086,153 A 7/2000 Heidmann et al.
6,116,695 A 9/2000 Heidmann et al.
6,179,384 B1 1/2001 DeKraker et al.
6,254,186 B1 7/2001 Falzon
6,257,664 B1 * 7/2001 Chew ..... A47C 7/405 297/284.9
6,357,826 B1 3/2002 Gabas et al.
6,367,877 B1 4/2002 Knoblock et al.
6,394,545 B2 5/2002 Knoblock et al.
6,394,548 B1 5/2002 Battey et al.
6,394,549 B1 5/2002 DeKraker et al.
6,402,246 B1 6/2002 Mundell
6,520,580 B1 2/2003 Hong
6,572,190 B2 6/2003 Koepke et al.
6,575,530 B1 6/2003 Fischer et al.
6,609,755 B2 8/2003 Koepke et al.
6,616,228 B2 9/2003 Heidmann
6,631,951 B2 10/2003 Blendea et al.
6,676,214 B2 1/2004 McMillen et al.
6,695,402 B2 2/2004 Sloan, Jr.
6,729,691 B2 5/2004 Koepke et al.
6,880,886 B2 4/2005 Bodnar et al.
6,908,153 B2 6/2005 Blendea
6,932,430 B2 8/2005 Bedford et al.
6,938,955 B2 9/2005 VanSickle
7,007,568 B2 3/2006 MacAulay et al.
7,014,269 B2 3/2006 Coffield et al.
7,044,551 B2 5/2006 Fujita et al.
7,066,537 B2 6/2006 Coffield et al.
7,131,694 B1 11/2006 Buffa
7,140,681 B2 11/2006 McMillen
7,165,811 B2 1/2007 Bodnar et al.
7,204,556 B2 4/2007 Schwerdtner et al.
7,226,130 B2 6/2007 Tubergen et al.
7,264,311 B2 9/2007 Heidmann
7,448,684 B2 11/2008 Hsiao
7,770,972 B2 8/2010 Popa
8,091,966 B2 1/2012 Schweizer et al.
8,091,967 B2 1/2012 Schweizer et al.
8,474,909 B2 7/2013 LaPointe et al.
8,506,009 B2 8/2013 LaPointe et al.
8,807,651 B2 8/2014 LaPointe et al.
9,604,559 B2 * 3/2017 Yoo ..... B60N 2/666
9,732,832 B2 8/2017 Kristen
9,744,891 B2 8/2017 Cho et al.
10,066,717 B2 9/2018 Kristen
2002/0113472 A1 8/2002 Blendea et al.
2002/0195854 A1 12/2002 Hong
2003/0006636 A1 1/2003 Ligon et al.
2004/0104609 A1 6/2004 Blendea
2004/0108760 A1 6/2004 McMillen
2004/0160099 A1 8/2004 Hong
2005/0046251 A1 3/2005 Foelster et al.
2006/0244293 A1 11/2006 Buffa
2007/0108816 A1 5/2007 McQueen et al.
2008/0164738 A1 7/2008 Colja et al.
2008/0217978 A1 9/2008 Stossel et al.
2009/0079245 A1 3/2009 Marcantoni
2010/0033002 A1 2/2010 Di Giusto et al.
2011/0115268 A1 5/2011 Maierhofer et al.
2011/0127817 A1 6/2011 Yu et al.
2012/0068508 A1 3/2012 LaPointe et al.
2013/0341982 A1 12/2013 Maierhofer et al.
2014/0070583 A1 * 3/2014 McMillen ..... B60N 2/6671 297/284.4
2014/0070584 A1 3/2014 McMillen et al.
2014/0125101 A1 5/2014 Hong
2014/0125102 A1 5/2014 McMillen et al.
2014/0125103 A1 5/2014 Suzuki
2015/0305506 A1 10/2015 Suzuki et al.
2016/0250957 A1 9/2016 Yoo

FOREIGN PATENT DOCUMENTS

EP 0458440 A1 11/1991
JP S6137212 A 2/1986
JP S6137213 A 2/1986
JP H01143958 U 10/1989
JP H05207920 U 8/1993
JP H0819452 A 1/1996
JP 2003159149 A 6/2003
JP 2014094598 A 5/2014
KR 20030075271 A 9/2003
KR 101149075 B1 5/2012
KR 101388983 B1 4/2014
KR 20140048743 A 4/2014
KR 101491313 B1 2/2015
WO WO-2008006200 A1 1/2008

OTHER PUBLICATIONS

Written Opinion of the International Searching Authority for Application No. PCT/US2011/047371, dated Apr. 9, 2012.
Supplementary European Search Report for Application No. 11827153.5, dated Jan. 21, 2014.
International Search Report for Application No. PCT/US2019/059803, dated Apr. 7, 2020.
Written Opinion of the International Searching Authority for Application No. PCT/US2019/059803, dated Apr. 7, 2020.

* cited by examiner

FURNITURE MEMBER HAVING LUMBAR ADJUSTMENT MECHANISM

CROSS-REFERENCE TO RELATED APPLICATIONS

This application claims the benefit of U.S. Provisional Application No. 62/755,849, filed on Nov. 5, 2018. The entire disclosure of the above application is incorporated herein by reference.

FIELD

The present disclosure relates to an adjustment mechanism, such as a lumbar adjustment mechanism for a seating or furniture assembly.

BACKGROUND

This section provides background information related to the present disclosure and is not necessarily prior art.

A furniture member (e.g., a chair, sofa, loveseat, etc.) may include an adjustable lumbar support that allows a user to adjust the amount of support that a seatback of the furniture member provides at a lumbar portion of the user's back. The present disclosure provides a lumbar adjustment assembly that is compact in size while still providing a sufficiently large range of motion. The lumbar adjustment assembly of the present disclosure fits within a slimmer space within a seatback frame, which allows for a wider variety of aesthetic designs of the seatback without sacrificing functionality.

SUMMARY

This section provides a general summary of the disclosure, and is not a comprehensive disclosure of its full scope or all of its features.

The present disclosure provides an assembly (e.g., a seating or furniture assembly) that may include a seat bottom, a seatback, and a lumbar adjustment assembly. The seatback is disposed adjacent the seat bottom and includes a seatback frame. The lumbar adjustment assembly may be mounted to the seatback frame and may include a rail, a threaded rod disposed within the rail, a first slider block slidably engaging the rail, a second slider block slidably engaging the rail, one or more lumbar pads, and a plurality of links connecting the lumbar pad to the first and second slider blocks. The threaded rod may include a first threaded section having threads with a first handedness and a second threaded section having threads with a second handedness that is opposite the first handedness. The first slider block may threadably engage the first threaded section. The second slider block may threadably engage the second threaded section.

In some configurations of the assembly of the above paragraph, the assembly includes a motor assembly attached to the rail and rotatably driving the threaded rod relative to the rail.

In some configurations of the assembly of either of the above paragraphs, the links include a pair of first links and a pair of second links.

In some configurations of the assembly of any or more of the above paragraphs, a first end of each of the first links is rotatably coupled to the first slider block, a second end of each of the first links is rotatably coupled to the lumbar pad, a first end of each of the second links is rotatably coupled to the second slider block, and a second end of each of the second links is rotatably coupled to the lumbar pad.

In some configurations of the assembly of any or more of the above paragraphs, the second ends of the first links and the second ends of the second links are rotatably coupled to the lumbar pad at a common rotational axis.

In some configurations of the assembly of any or more of the above paragraphs, the lumbar pad moves in a direction perpendicular to a direction in which the first and second slider blocks move along the rail.

In some configurations of the assembly of any or more of the above paragraphs, the lumbar pad moves away from the rail when the first and second slider blocks move toward each other along the rail, and the lumbar pad moves toward from the rail when the first and second slider blocks move away from each other along the rail. In other configurations of the assembly, the first and second links could be configured such that the lumbar pad moves away from the rail when the first and second slider blocks move away from each other along the rail, and the lumbar pad moves toward from the rail when the first and second slider blocks move toward each other along the rail.

In some configurations of the assembly of any or more of the above paragraphs, the seatback frame includes a lower cross member, an upper cross member, a first lateral support member, and a second lateral support member. A motor assembly of the lumbar adjustment assembly may be attached to the first lateral support member and the rail is attached to the second lateral support member.

In some configurations of the assembly of any or more of the above paragraphs, each of the first and second slider blocks includes a channel that slidably and non-rotatably receives the rail.

In some configurations of the assembly of any or more of the above paragraphs, the threaded rod is a single, unitary body.

The present disclosure also provides an assembly (e.g., a seating or furniture assembly) that may include a frame, a motor assembly, a rail, a threaded rod, a first slider block, a second slider block, and a plurality of links. The motor assembly may include a housing attached to the frame. The rail may include a first end attached to the motor assembly and a second end attached to the frame. The threaded rod may be coupled to the motor assembly and may be disposed within a channel of the rail. The threaded rod may include a first threaded section having threads with a first handedness and a second threaded section having threads with a second handedness that is opposite the first handedness. The first slider block may slidably engage the rail and may threadably engage the first threaded section. The second slider block may slidably engage the rail and may threadably engage the second threaded section. The plurality of links may be rotatably coupled to the first and second slider blocks.

In some configurations of the assembly of the above paragraph, the assembly may include a support member attached to the plurality of links.

In some configurations of the assembly of either of the above paragraphs, the support member is a lumbar pad, and the frame is a seatback frame.

In some configurations of the assembly of any one or more of the above paragraphs, the seatback frame includes a lower cross member, an upper cross member, a first lateral support member, and a second lateral support member. The housing of the motor assembly may be attached to the first lateral support member and the second end of the rail may be attached to the second lateral support member.

In some configurations of the assembly of any one or more of the above paragraphs, the links include a pair of first links and a pair of second links.

In some configurations of the assembly of any one or more of the above paragraphs, a first end of each of the first links is rotatably coupled to the first slider block, a second end of each of the first links is rotatably coupled to the support member, a first end of each of the second links is rotatably coupled to the second slider block, and a second end of each of the second links is rotatably coupled to the support member.

In some configurations of the assembly of any one or more of the above paragraphs, the second ends of the first links and the second ends of the second links are rotatably coupled to the support member at a common rotational axis.

In some configurations of the assembly of any one or more of the above paragraphs, the support member moves in a direction perpendicular to a direction in which the first and second slider blocks move along the rail.

In some configurations of the assembly of any one or more of the above paragraphs, the support member moves away from the rail when the first and second slider blocks move toward each other along the rail, and the support member moves toward from the rail when the first and second slider blocks move away from each other along the rail. In other configurations of the assembly, the first and second links could be configured such that the support member moves away from the rail when the first and second slider blocks move away from each other along the rail, and the support member moves toward from the rail when the first and second slider blocks move toward each other along the rail.

In some configurations of the assembly of any one or more of the above paragraphs, each of the first and second slider blocks includes a channel that slidably and non-rotatably receives the rail.

In some configurations of the assembly of any one or more of the above paragraphs, the threaded rod is a single, unitary body.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
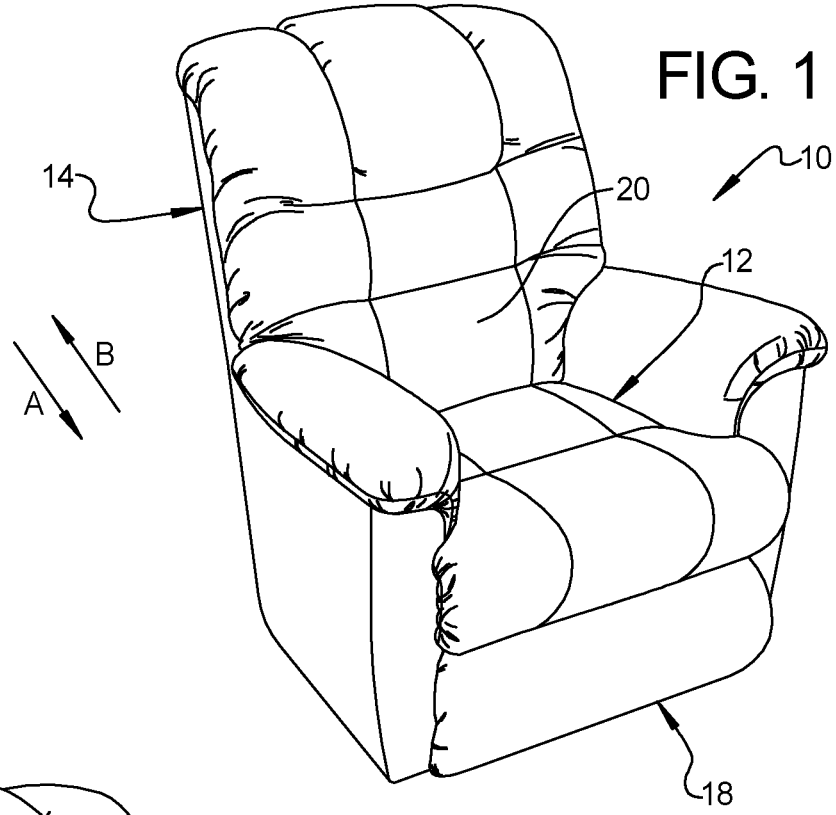
FIG. 1 is a perspective view of a furniture member with a legrest mechanism in a retracted position.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
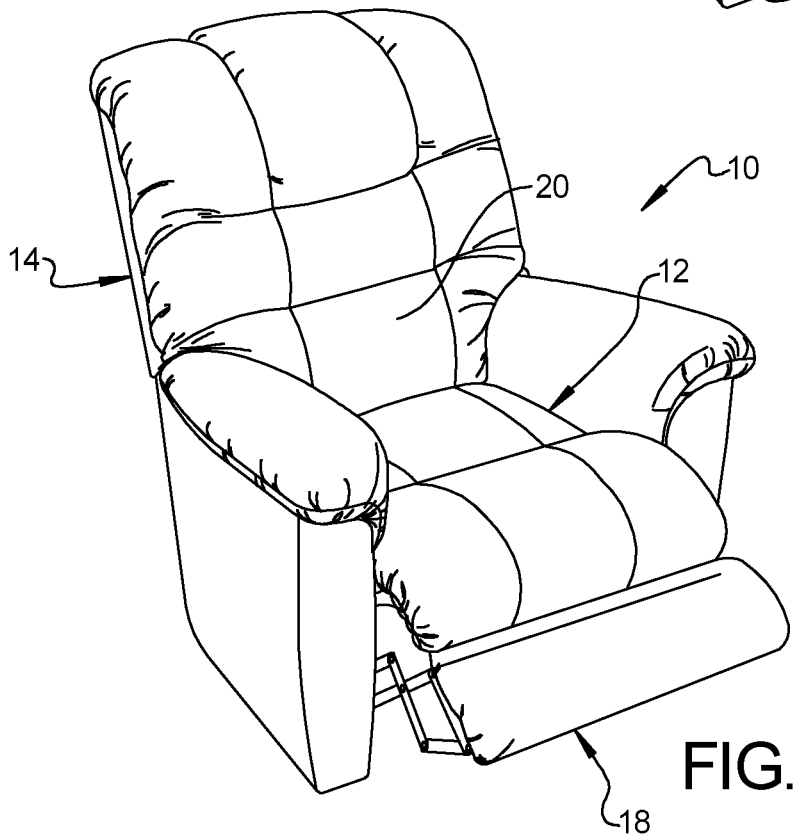
FIG. 2 is a perspective view of the furniture member with the legrest mechanism in an extended position.

With reference to FIGS. 1-11, a seating or furniture assembly 10 (FIGS. 1 and 2) is provided that may include a seat bottom 12, a seatback 14, and a lumbar adjustment mechanism or assembly 16 (FIGS. 3-11). In some configurations, the seatback 14 may be movable relative to the seat bottom 12 between reclined and upright positions. In some configurations, the seating or furniture assembly 10 may include a legrest assembly 18 that is movable relative to the seat bottom 12 between a retracted position (FIG. 1) and an extended position (FIG. 2). The seatback 14 includes a lumbar support section 20 in which the lumbar adjustment assembly 16 is disposed. As will be described in more detail below, the lumbar adjustment assembly 16 can be actuated to move the lumbar support section 20 of the seatback 14 in a lumbar extension direction A to increase occupant lumbar support or in a lumbar retraction direction B to decrease occupant lumbar support. The lumbar adjustment assembly 16 is operable independently of any seatback reclining mechanism, tilting mechanism or the legrest assembly 18.

Figure 3:
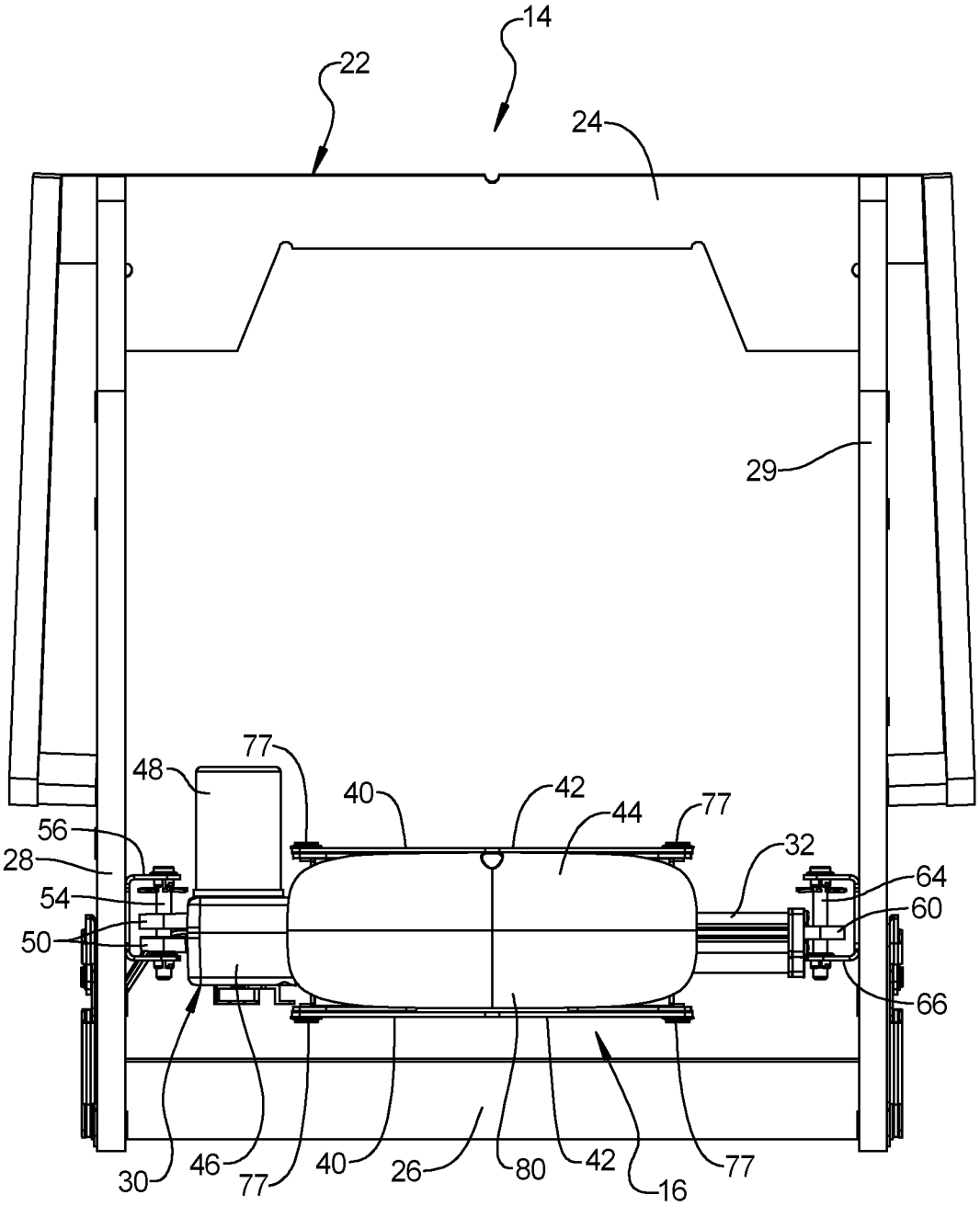
FIG. 3 is a front view of a seatback of the furniture member with upholstery and padding removed to show a lumbar adjustment assembly.
Figure 4:
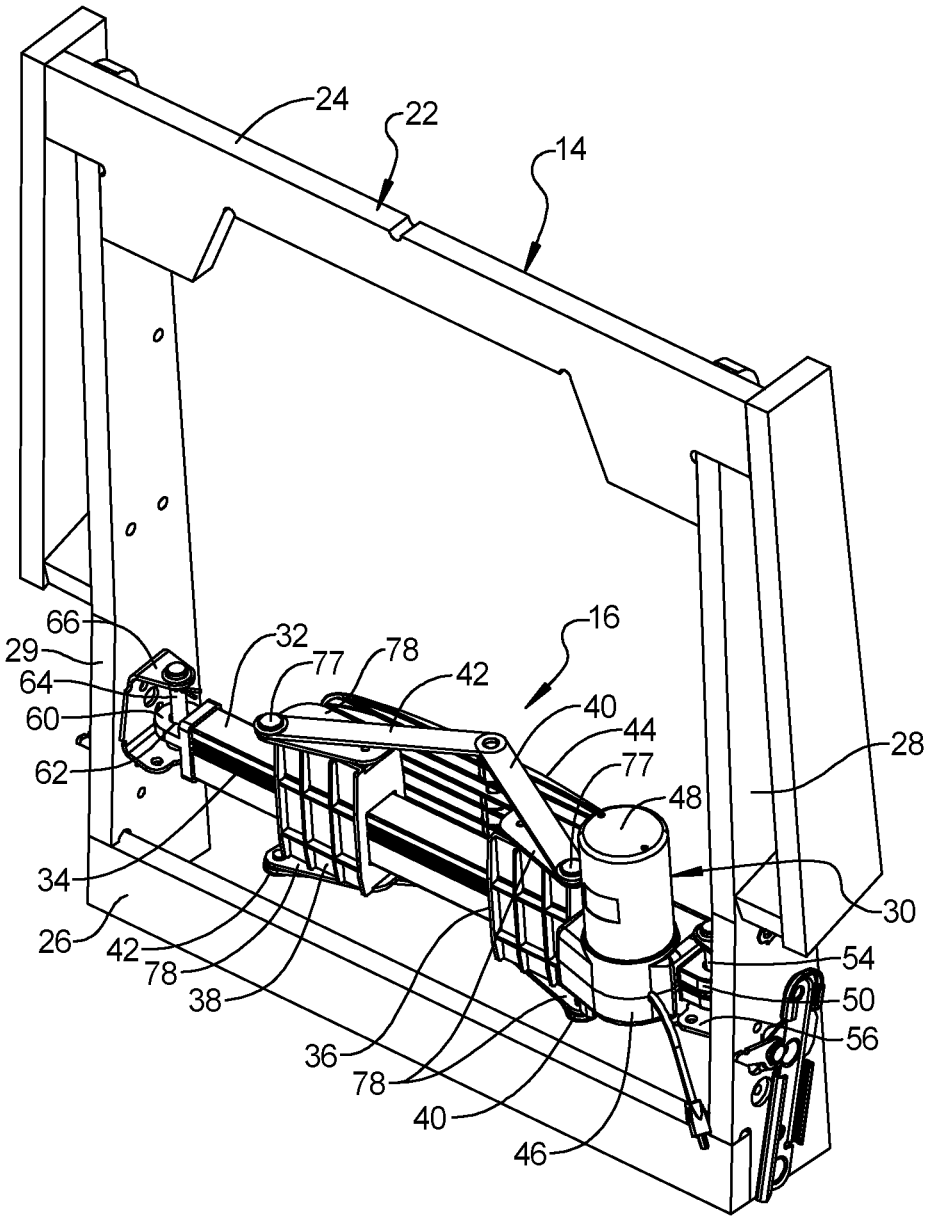
FIG. 4 is a perspective view of the seatback and lumbar adjustment assembly.

Referring now to FIGS. 3 and 4, the seatback 14 includes a seatback frame 22 (which, in FIGS. 1 and 2, is shown covered with padding and upholstery) that may have an upper cross member 24, a lower cross member 26 (i.e., the end adjacent the seat bottom 12 when the seating or furniture assembly 10 is fully assembled), and first and second lateral support members 28, 29 extending between the upper and lower cross members 24, 26. The lumbar adjustment assembly 16 may be mounted to the first and second lateral support members 28, 29. The lumbar adjustment assembly 16 may be disposed between the upper and lower cross members 24, 26 at a location corresponding to the lumbar support section 20 (FIGS. 1 and 2) of the seatback 14.

As shown in FIGS. 3-11, the lumbar adjustment assembly 16 may include a motor assembly 30, a rail 32, a threaded rod 34, a first slider block 36, a second slider block 38, a pair of first links 40, a pair of second links 42, and a lumbar pad or support member 44. The motor assembly 30 may include a housing 46 and a motor 48. The housing 46 may include one or more mounting projections 50 each having an aperture 52. A connecting pin 54 may extend through the aperture(s) 52 and engage a mounting bracket 56 that is fixedly attached to the first lateral support member 28. It will be appreciated that the motor assembly 30 could be mounted to the seatback 14 in any suitable manner.

Figure 5:
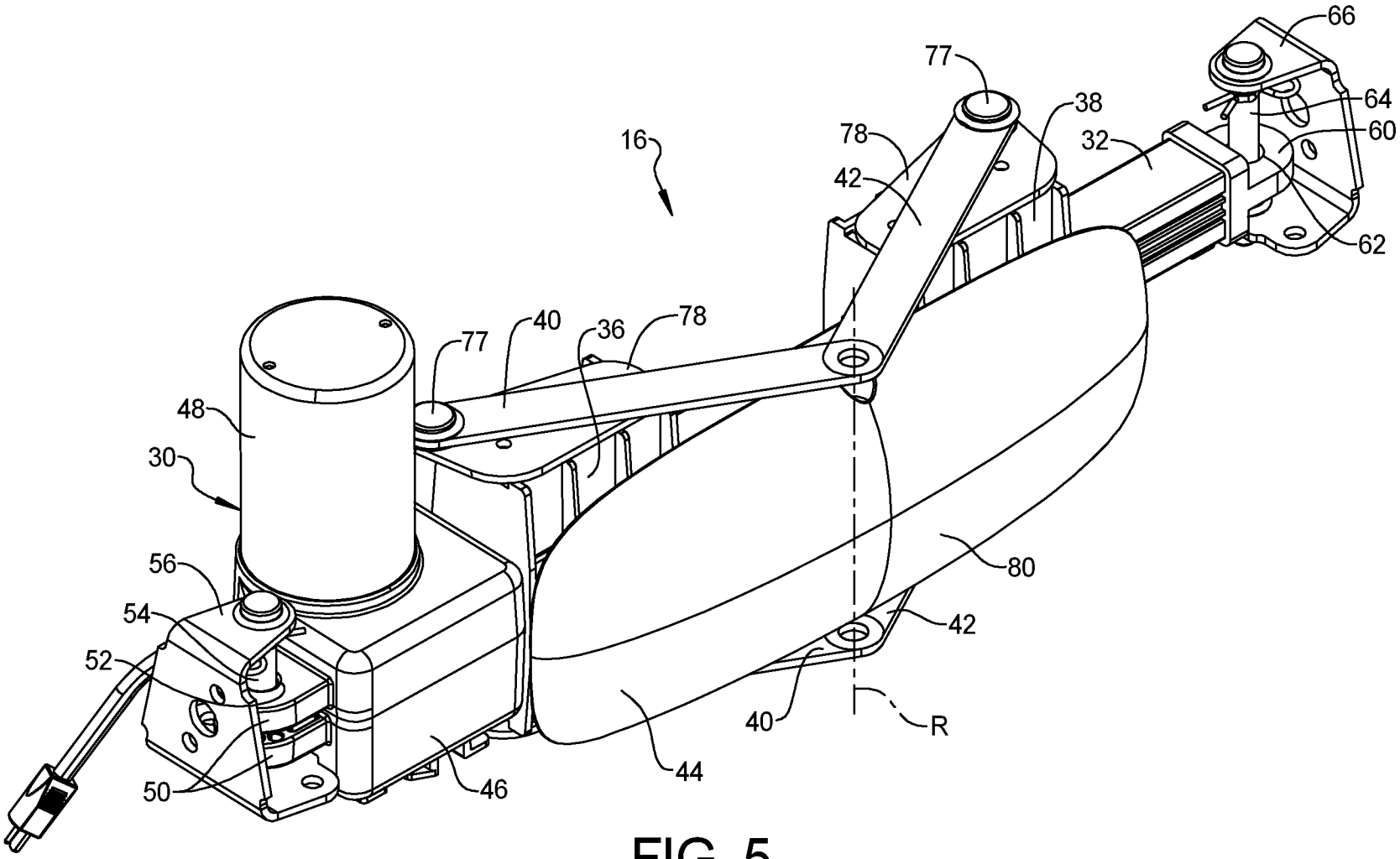
FIG. 5 is a perspective view of the lumbar adjustment assembly in a retracted position.
Figure 6:
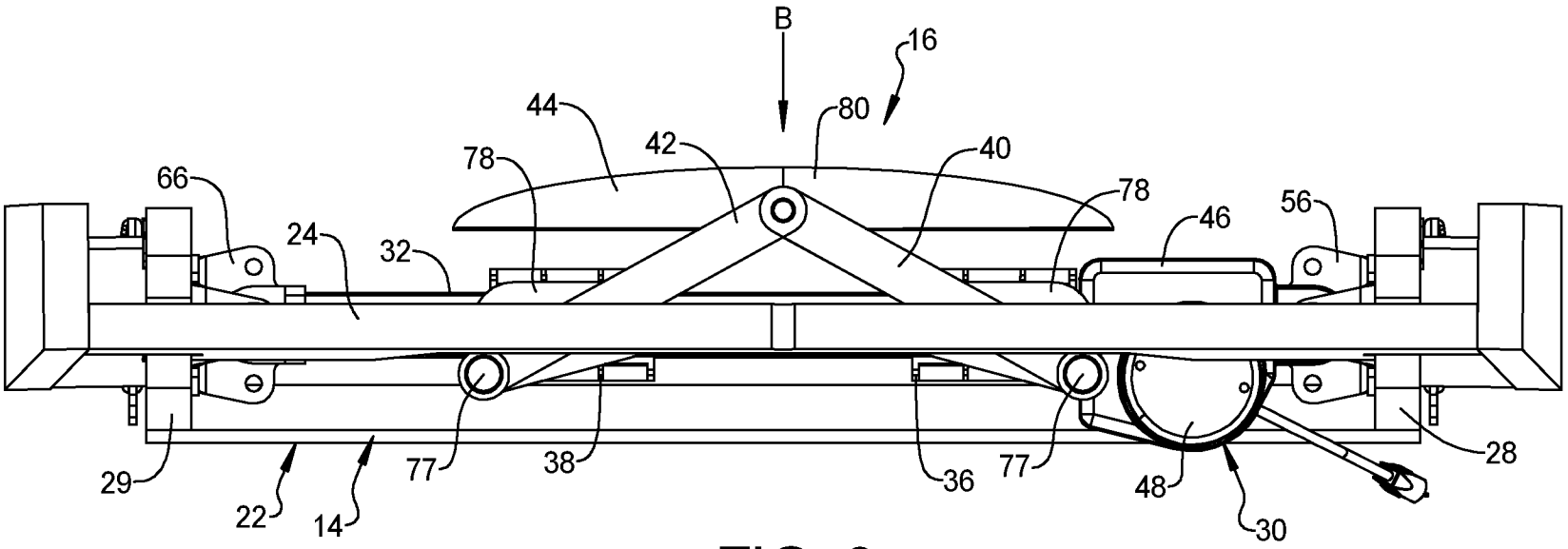
FIG. 6 is a top view of the seatback and lumbar adjustment assembly in the retracted position.

The motor 48 may be attached to and/or disposed at least partially within the housing 46. The motor 48 may be operatively coupled (e.g., via one or more output shafts disposed in the motor housing 46 and, in some configurations, via gears and/or other couplings) to the threaded rod 34 such that operation of the motor 48 causes rotation of the threaded rod 34 about a longitudinal axis of the threaded rod 34. As will be described in more detail below, operation of the motor 48 in a first direction causes the lumbar pad 44 to move relative to the seatback 14 in the lumbar extension direction A toward an extended position (FIGS. 7 and 8), and operation of the motor 48 in a second direction causes the lumbar pad 44 to move relative to the seatback 14 in the lumbar retraction direction B toward a retracted position (FIGS. 5 and 6).

The rail 32 may be an elongated member that defines an internal cavity 58 (FIGS. 10 and 11) in which the threaded rod 34 is disposed. One end of the rail 32 may be fixedly attached to the housing 46 and another end of the rail 32 may include a mounting projection 60. The mounting projection 60 may include an aperture 62 that receives a connecting pin 64 that engages a mounting bracket 66 that is fixedly attached to the second lateral support member 29.

Figure 9:
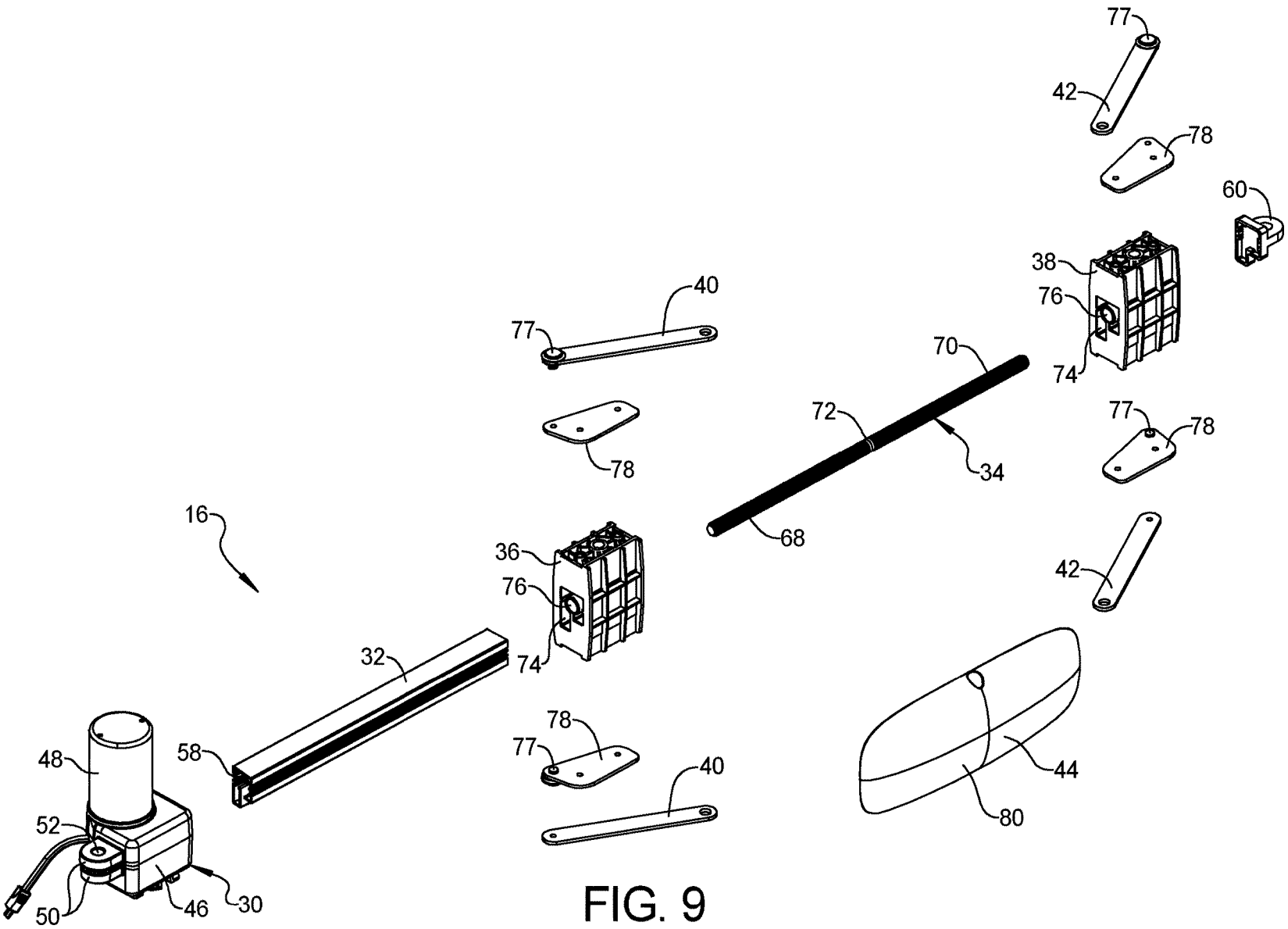
FIG. 9 is an exploded view of the lumbar adjustment assembly.
Figure 11:
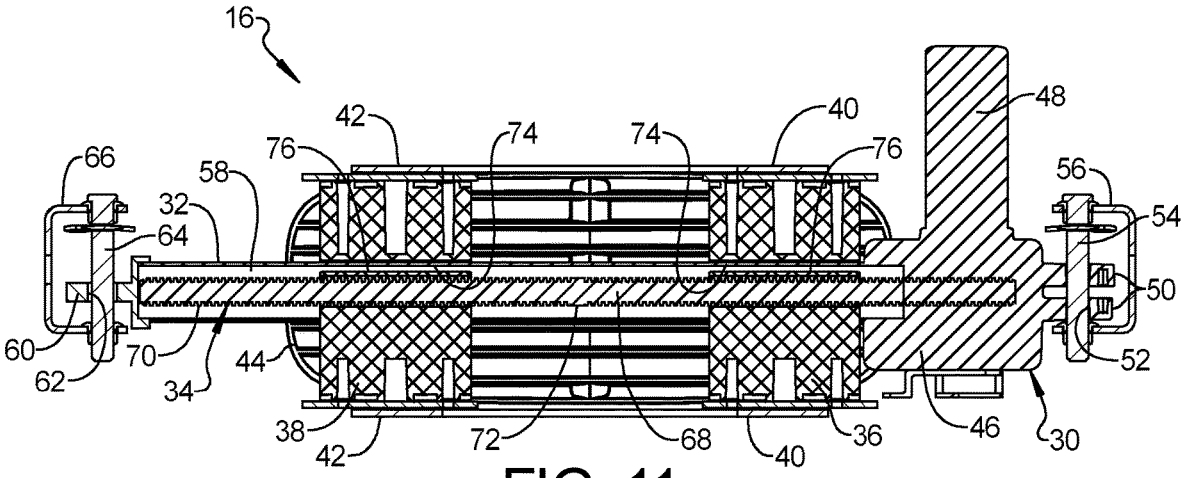
FIG. 11 is another cross-sectional view of the lumbar adjustment assembly.

The threaded rod 34 may be an elongated cylindrical rod that is coupled to the motor 48 and threadably engages the first and second slider blocks 36, 38. As shown in FIGS. 9 and 11, the threaded rod 34 may include a first threaded section 68 and a second threaded section 70. The first threaded section 68 and the second threaded section 70 may have threads of opposite handedness. For example, the first threaded section 68 may have right-handed threads and the second threaded section 70 may have left-handed threads, or the first threaded section 68 may have left-handed threads and the second threaded section 70 may have right-handed threads.

The threaded rod 34 may include an intermediate section 72 (FIGS. 9 and 11) disposed between the first and second threaded sections 68, 70. The intermediate section 72 defines a transitional portion of the threaded rod 34 between the first and second threaded sections 68, 70. In some configurations, the intermediate section 72 may be unthreaded. The first threaded section 68 may extend between the motor assembly 30 and the intermediate section 72 and may threadably engage the first slider block 36. The second threaded section 70 may threadably engage the first slider block 36 and may extend between the intermediate section 72 and the mounting projection 60 attached to the second lateral support member 28.

The opposite handedness of the first and second threaded portions 68, 70 causes the first and second slider blocks 36, 38 to move in opposite directions while the threaded rod 34 rotates. That is, rotation of the threaded rod 34 in one direction causes the first and second slider blocks 36, 38 to move toward each other along the rail 32, and rotation of the threaded rod 34 in the opposite direction causes the first and second slider blocks 36, 38 to move away from each other along the rail 32.

Figure 10:
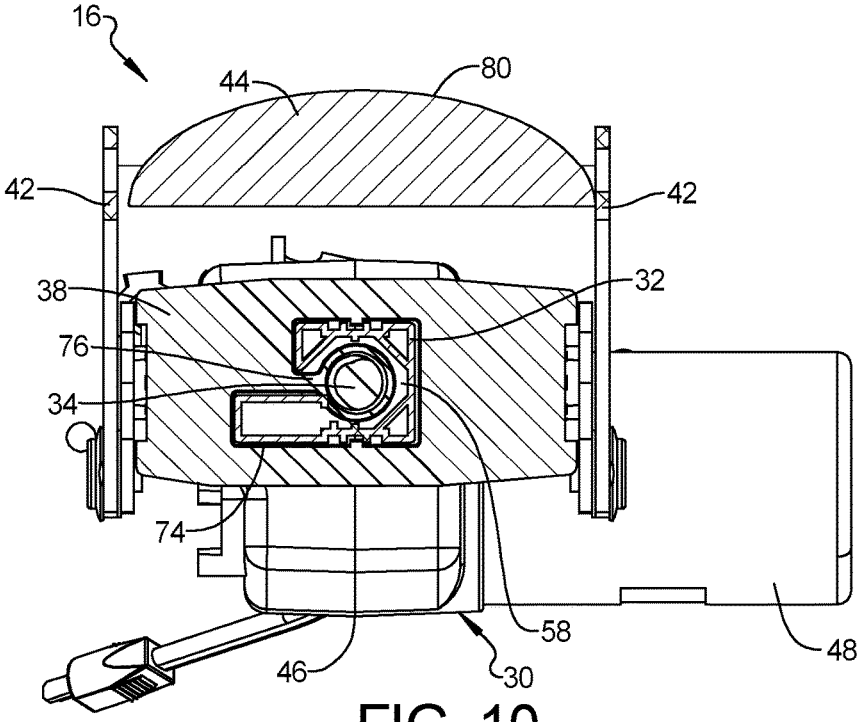
FIG. 10 is a cross-sectional view of the lumbar adjustment assembly.

The first and second slider blocks 36, 38 may be similar or identical to each other and may each include a channel 74 that movably receives the rail 32. As shown in FIG. 10, the channel 74 has a cross-sectional shape that substantially matches the outer cross-sectional shape of the rail 32. In this manner, the first and second slider blocks 36, 38 can slide along the rail 32.

As shown in FIG. 10, each of the first and second slider blocks 36, 38 may include a nut portion 76 that extends from a main body of the slider block 36, 38 into the channel 74 and threadably engages the threaded rod 34. That is, the nut portion 76 includes a threaded aperture through which the threaded rod 34 is threadably received. The nut portion 76 of the first slider block 36 threadably engages the first threaded section 68 of the threaded rod 34. The nut portion 76 of the second slider block 38 threadably engages the second threaded section 70 of the threaded rod 34. Therefore, the nut portions 76 of the first and second slider blocks 36, 38 have different threaded handedness (i.e., the nut portion 76 of the first slider block 36 has the same thread handedness as the first threaded section 68, and the nut portion 76 of the second slider block 38 has the same thread handedness as the second threaded section 70).

Since the cross-sectional shape of the channel 74 of the slider blocks 36, 38 substantially matches the cross-sectional shape of the rail 32, the rail 32 prevents the slider blocks 36, 38 from rotating with the threaded rod 34 and allows the slider blocks 36, 38 to slide along the rail 32 (in a direction along the longitudinal axis of the threaded rod 34) while the threaded rod 34 rotates relative to the rail 32. As described above, because the first and second threaded sections 68, 70 of the threaded rod 34 have threads of opposite handedness, rotation of the threaded rod 34 in one direction causes the first and second slider blocks 36, 38 to move toward each other along the rail 32, and rotation of the threaded rod 34 in the opposite direction causes the first and second slider blocks 36, 38 to move away from each other along the rail 32 (compare FIGS. 5 and 7 or FIGS. 6 and 8).

Figure 7:
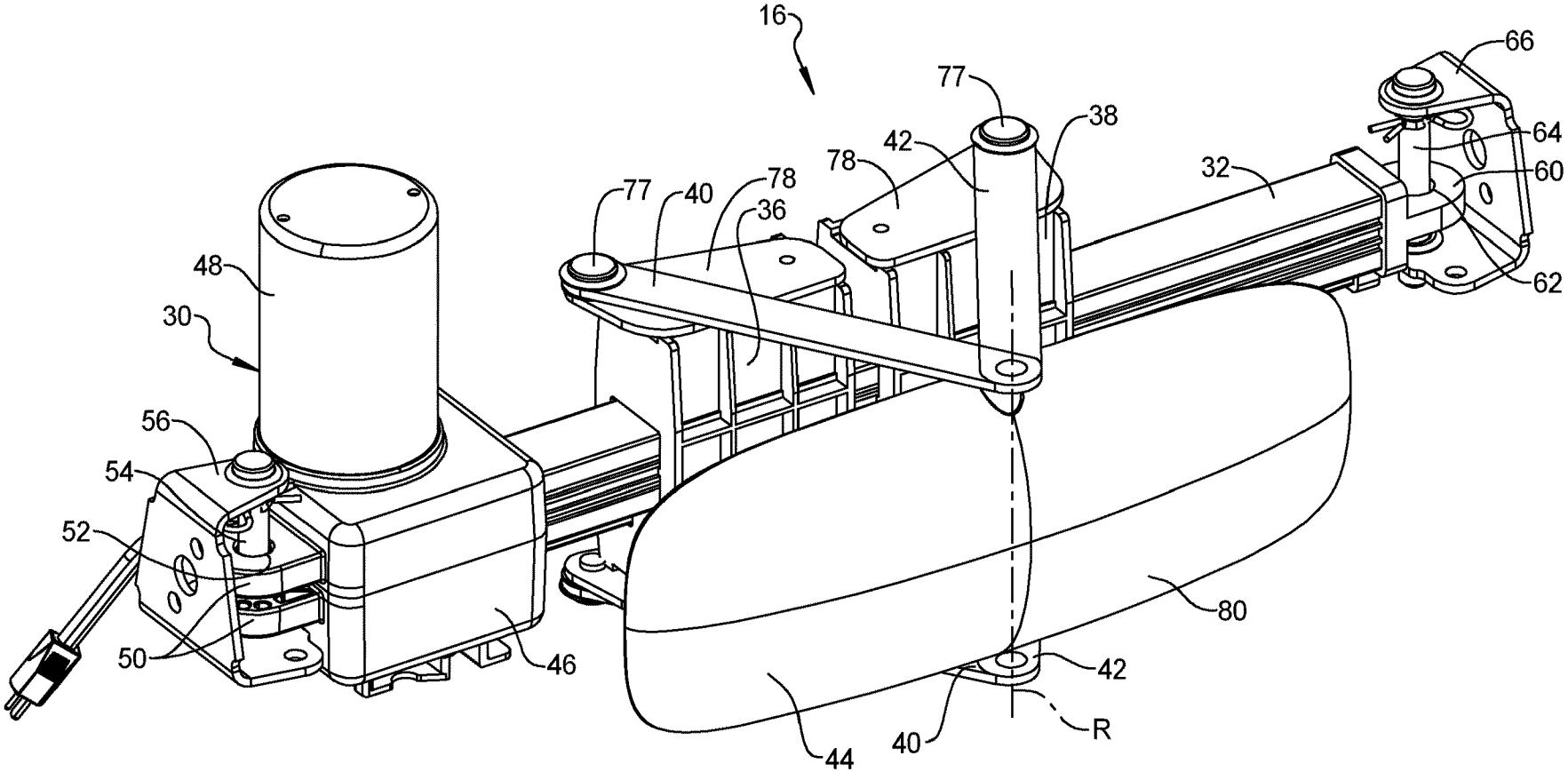
FIG. 7 is a perspective view of the lumbar adjustment assembly in an extended position.
Figure 8:
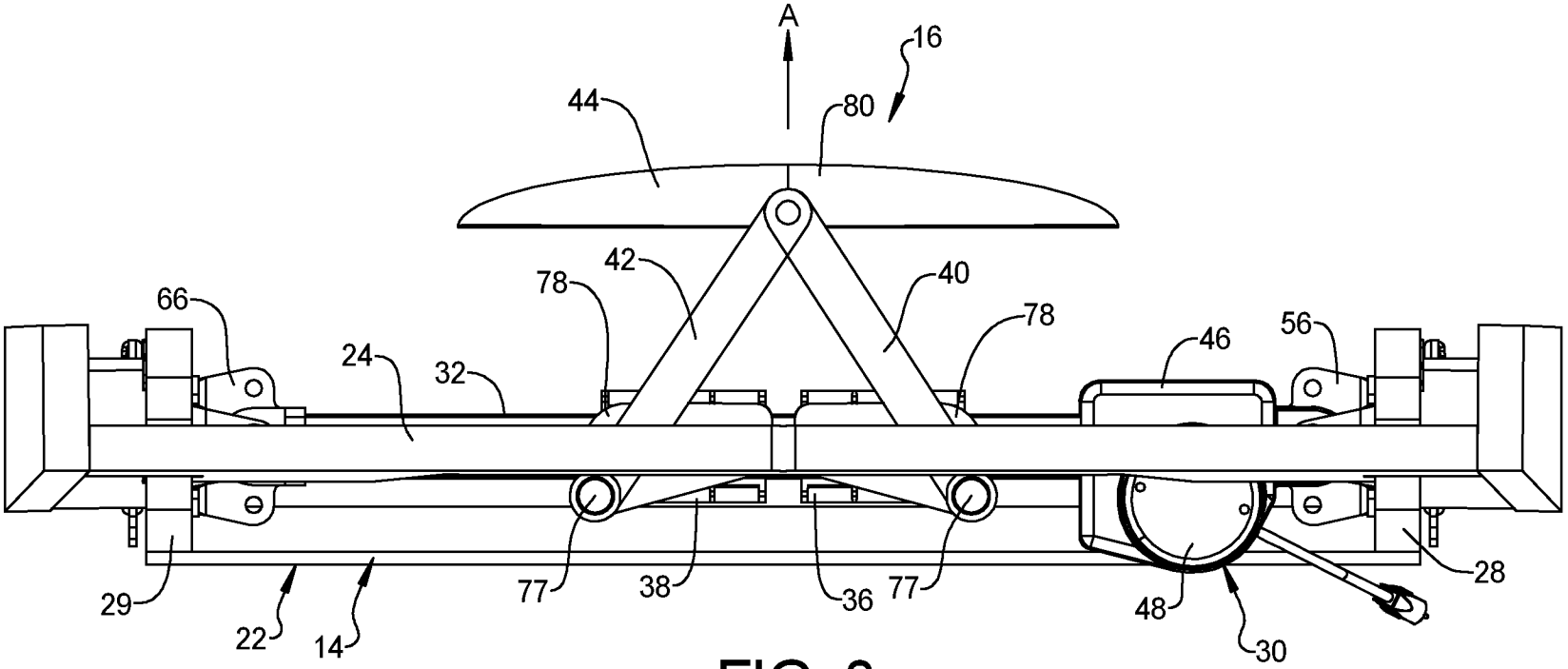
FIG. 8 is a top view of the seatback and lumbar adjustment assembly in the extended position.

The first links 40 and the second links 42 may be similar or identical to each other. As shown in FIGS. 5 and 7, first ends of the first links 40 are rotatably connected to the first slider block 36 (e.g., via pins 77) and second ends of the first links 40 are rotatably connected to the lumbar pad 44 (e.g., via pins or fasteners; not shown). First ends of the second links 42 are rotatably connected to the second slider block 38 (e.g., via pins 77) and second ends of the second links 42 are rotatably connected to the lumbar pad 44 (e.g., via pins or fasteners; not shown). In the configuration shown in the figures, bracket plates 78 (FIGS. 4 and 5) are fixedly attached (e.g., via threaded fasteners; not shown) to opposing sides of each of the slider blocks 36, 38. The links 40, 42 are rotatably attached to the bracket plates 78 (e.g., via pins 77). As shown in FIGS. 5 and 7, the first and second links 40, 42 may be coupled to the lumbar pad 44 along a common rotational axis R. In some configurations, however, the first links 40 may be coupled to the lumbar pad 44 along a first rotational axis, and the second links 42 may be coupled to the lumbar pad 44 along a second rotational axis that is spaced apart from the first rotational axis.

The lumbar pad 44 may be a relatively rigid member and may have a contoured support surface 80 (FIG. 5). The support surface 80 may be in contact with and/or adjacent to the padding and upholstery that covers the seatback 14. The lumbar adjustment assembly 16 may be positioned on the seatback frame 22 such that the support surface 80 corresponds to the lumbar support section 20 of the seatback 14 (i.e., the support surface 80 of the lumbar pad 44 supports the lumbar portion of a person's back who is sitting in the seating or furniture assembly 10).

With continued reference to FIGS. 1-11, operation of the lumbar adjustment assembly 16 will be described in detail. A user sitting in the seating or furniture assembly 10 can actuate the lumbar adjustment assembly 16 to adjust the position of the lumbar support section 20 of the seatback 14. Movement of the lumbar adjustment assembly 16 from the retracted position (FIGS. 5 and 6) to the extended position (FIGS. 7 and 8) causes the lumbar pad 44 to move in the lumbar extension direction A (FIG. 1); and movement of the lumbar adjustment assembly 16 from the extended position to the retracted position causes the lumbar pad 44 to move in the lumbar retraction direction B. Movement of the lumbar pad 44 toward the extended position moves the lumbar support section 20 (e.g., padding and/or upholstery covering the lumbar support section 20 of the seatback 14) in the lumbar extension direction A; and movement of the lumbar pad 44 toward the retracted position allows the lumbar support section 20 (e.g., the padding and/or upholstery covering the lumbar support section 20) to move in the lumbar retraction direction B.

To move the lumbar adjustment assembly 16 from the retracted position to the extended position, the user may press a button (not shown) or other switch or control interface located on the side of the seating or furniture assembly 10 or on a remote control (not shown), for example, to operate the motor 48 to drive the threaded rod 34 in a first rotational direction relative to the rail 32. As described above, rotation of the threaded rod 34 in the first rotational direction causes the first and second slider blocks 36, 38 to move linearly toward each other along the rail 32. As the first and second slider blocks 36, 38 move toward each other along the rail 32, the links 40, 42 rotate relative to the slider blocks 36, 38 and force the lumbar pad 44 to move linearly in the lumbar extension direction A (see FIG. 8). The lumbar extension direction A may be perpendicular to the direction in which the slider blocks 36, 38 move along the rail 32. In other configurations, the links 40, 42 could be configured such that the lumbar extension direction A extends at a non-perpendicular angle relative to the rail 32. In some configurations, the links 40, 42 could be configured such that the lumbar pad 44 moves in the lumbar extension direction A (i.e., away from the rail 32) when the first and second slider blocks 36, 38 move away from each other along the rail, and the lumbar pad 44 moves in the lumbar retraction direction B (i.e., toward from the rail 32) when the first and second slider blocks 36, 38 move toward each other along the rail 32.

To move the lumbar adjustment assembly 16 from the extended position to the retracted position, the user may press another button (not shown) on the side of the seating or furniture assembly 10 or on the remote control (not shown), for example, to operate the motor 48 to drive the threaded rod 34 in a second rotational direction (opposite the first rotational direction) relative to the rail 32. Rotation of the threaded rod 34 in the second rotational direction causes the first and second slider blocks 36, 38 to move linearly away from each other along the rail 32. As the first and second slider blocks 36, 38 move away from each other along the rail 32, the links 40, 42 rotate relative to the slider blocks 36, 38 and force the lumbar pad 44 to move linearly in the lumbar retraction direction B (see FIG. 6). The lumbar retraction direction B may be perpendicular to the direction in which the slider blocks 36, 38 move along the rail 32. In other configurations, the links 40, 42 could be configured such that the lumbar retraction direction B extends at a non-perpendicular angle relative to the rail 32.

In the particular example shown in FIGS. 1 and 2, the assembly 10 is a chair; however, the principles of the present disclosure are not limited to chairs. That is, the lumbar adjustment assembly 16 can be incorporated into a variety of types of seating or furniture assemblies including single or multiple person furniture members, sofas, sectional members, loveseats, vehicle seating, dental seating, medical seating, etc. Furthermore, in any given seating or furniture assembly, the lumbar adjustment assembly 16 may be one of a plurality of movable or adjustable portions of the seating or furniture assembly, or the lumbar adjustment assembly 16 could be the only movable or adjustable portion of the seating or furniture assembly.

While the lumbar adjustment assembly 16 is described above as being driven by the motor assembly 30, in some configurations, the lumbar adjustment assembly 16 could be manually driven.

Furthermore, while the threaded rod 34 shown in the figures is a single, unitary body, in some configurations, the threaded rod 34 could be formed by welding or otherwise attaching two rods (one rod corresponding to each of the first and second threaded sections 68, 70) together.

In some configurations, the threads of the first and second threaded sections 68, 70 have the same pitch. In other configurations, the threads of the first threaded section 68 may have a different pitch than the threads of the second threaded section 70. The different pitches of the threads of the first and second threaded sections 68, 70 can allow the first and second slider blocks 36, 38 to move at different speeds.

The links 40, 42 could be shaped, sized, oriented and connected to the slider blocks 36, 38 and lumbar pad 44 in any desired manner to produce any desired movement of the lumbar pad 44 (or multiple lumbar pads). Furthermore, the threaded rod 34, slider blocks 36, 38 and links 40, 42 could be configured to move additional or alternative components of a seating or furniture assembly (i.e., instead of or in addition to the lumbar pad 44).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An assembly comprising:

a seat bottom;

a seatback disposed adjacent the seat bottom and including a seatback frame; and a lumbar adjustment assembly mounted to the seatback frame and including a rail, a threaded rod disposed within the rail, a first slider block slidably engaging the rail, a second slider block slidably engaging the rail, a lumbar pad, and a plurality of links connecting the lumbar pad to the first and second slider blocks, wherein the threaded rod includes a first threaded section having threads with a first handedness and a second threaded section having threads with a second handedness that is opposite the first handedness, and wherein the first slider block threadably engages the first threaded section and the second slider block threadably engages the second threaded section.

2. The assembly of claim 1, further comprising a motor assembly attached to the rail and rotatably driving the threaded rod relative to the rail.

3. The assembly of claim 1, wherein the links include a pair of first links and a pair of second links.

4. The assembly of claim 3, wherein a first end of each of the first links is rotatably coupled to the first slider block, wherein a second end of each of the first links is rotatably coupled to the lumbar pad, wherein a first end of each of the second links is rotatably coupled to the second slider block, wherein a second end of each of the second links is rotatably coupled to the lumbar pad.

5. The assembly of claim 4, wherein the second ends of the first links and the second ends of the second links are rotatably coupled to the lumbar pad at a common rotational axis.

6. The assembly of claim 1, wherein the lumbar pad moves in a direction perpendicular to a direction in which the first and second slider blocks move along the rail.

7. The assembly of claim 6, wherein the lumbar pad moves away from the rail when the first and second slider blocks move toward each other along the rail, and wherein the lumbar pad moves toward from the rail when the first and second slider blocks move away from each other along the rail.

8. The assembly of claim 1, wherein the seatback frame includes a lower cross member, an upper cross member, a first lateral support member, and a second lateral support member, and wherein a motor assembly of the lumbar adjustment assembly is attached to the first lateral support member and the rail is attached to the second lateral support member.

9. The assembly of claim 1, wherein each of the first and second slider blocks includes a channel that slidably and non-rotatably receives the rail.

10. The assembly of claim 1, wherein the threaded rod is a single, unitary body.

11. An assembly comprising:

a frame;

a motor assembly including a housing attached to the frame;

a rail including a first end attached to the motor assembly and a second end attached to the frame;

a threaded rod coupled to the motor assembly and disposed within a channel of the rail, the threaded rod including a first threaded section having threads with a first handedness and a second threaded section having threads with a second handedness that is opposite the first handedness;

a first slider block slidably engaging the rail and threadably engaging the first threaded section;

a second slider block slidably engaging the rail and threadably engaging the second threaded section; and a plurality of links rotatably coupled to the first and second slider blocks.

12. The assembly of claim 11, further comprising a support member attached to the plurality of links.

13. The assembly of claim 12, wherein the support member is a lumbar pad, and wherein the frame is a seatback frame.

14. The assembly of claim 13, wherein the seatback frame includes a lower cross member, an upper cross member, a first lateral support member, and a second lateral support member, and wherein the housing of the motor assembly is attached to the first lateral support member and the second end of the rail is attached to the second lateral support member.

15. The assembly of claim 12, wherein the links include a pair of first links and a pair of second links.

16. The assembly of claim 15, wherein a first end of each of the first links is rotatably coupled to the first slider block, wherein a second end of each of the first links is rotatably coupled to the support member, wherein a first end of each of the second links is rotatably coupled to the second slider block, wherein a second end of each of the second links is rotatably coupled to the support member.

17. The assembly of claim 16, wherein the second ends of the first links and the second ends of the second links are rotatably coupled to the support member at a common rotational axis.

18. The assembly of claim 12, wherein the support member moves in a direction perpendicular to a direction in which the first and second slider blocks move along the rail.

19. The assembly of claim 18, wherein the support member moves away from the rail when the first and second slider blocks move toward each other along the rail, and wherein the support member moves toward from the rail when the first and second slider blocks move away from each other along the rail.

20. The assembly of claim 11, wherein each of the first and second slider blocks includes a channel that slidably and non-rotatably receives the rail.

21. The assembly of claim 11, wherein the threaded rod is a single, unitary body.

* * * * *